US006367602B1

(12) United States Patent
Chang

(10) Patent No.: US 6,367,602 B1
(45) Date of Patent: Apr. 9, 2002

(54) RETRACTABLE WHEEL FOR A BUILT-IN LUGGAGE CART

(76) Inventor: Fu-Jung Chang, 8-5 Fl., No. 191, Fi-Hsing N. Rd., Taipei (TW)

( * ) Notice: Subject to any disclaimer, the term of this patent is extended or adjusted under 35 U.S.C. 154(b) by 0 days.

(21) Appl. No.: 09/648,944

(22) Filed: Aug. 25, 2000

(30) Foreign Application Priority Data

Jul. 19, 2000 (TW) ..... 089212443

(51) Int. Cl.[7] ..... A59C 5/14
(52) U.S. Cl. ..... 190/18 A; 280/47.315
(58) Field of Search ..... 190/18 A, 104, 190/115; 280/47.315, 47.371, 37, 655

(56) References Cited

U.S. PATENT DOCUMENTS 4,254,850 A * 3/1981 Knowles ..... 190/18 A
4,575,190 A * 3/1986 Cowdery ..... 280/37
5,367,743 A 11/1994 Chang
5,371,923 A 12/1994 Chang
5,400,472 A 3/1995 Chang
5,553,350 A 9/1996 Chang
5,813,503 A 9/1998 Chang
6,081,967 A 7/2000 Chang
6,193,033 B1 * 2/2001 Sadow et al. ..... 190/18 A

* cited by examiner

*Primary Examiner*—Gary E. Elkins
*Assistant Examiner*—Lien Ngo
(74) *Attorney, Agent, or Firm*—Dellett and Walters

(57) ABSTRACT

A retractable wheel for a built-in luggage cart has a pair of telescopic pull rods, a handle mounted on the upper ends of the pull rods and retractable wheels provided at opposite sides of the lower edge of the luggage near the lower ends of the pull rods. The retractable wheel has a frame attached to the luggage and defined with a wheel well, a retractable wheel mount having an upper end pivotally connected to the frame, and a wheel rotatably attached to the lower end of the wheel mount, a strut vertically movable in the frame, a pair of arms having one end thereof pivotally connected to the strut and the other end thereof pivotally connected to the wheel mount, thereby the retractable wheel is extendable and retractable when the pull rods of the built-in luggage cart are extended and retracted.

10 Claims, 6 Drawing Sheets

RETRACTABLE WHEEL FOR A BUILT-IN LUGGAGE CART

BACKGROUND OF THE INVENTION

1. Field of the Invention

The present invention relates to a retractable wheels for a built-in luggage cart, and particularly to the wheelwhich is extended when the luggage is pulled and are retracted when the luggage is stowed.

2. Description of Related Art

Generally travelers, especially old people, find it tiring to have to carry their luggage during the trips. Built-in luggage carts are widely used to make it easier to carry luggage. However, conventional built-in luggage carts only have fixed wheels protruded out from the luggage, which can cause trouble when the wheels are hit and damaged during transportation. The wheels can also cause problems when the luggage is stowed or being collected because the protruding wheels use a lot of space. Patents such as U.S. Pat. No. 5,400,472; U.S. Pat. No. 5,553,350; U.S. Pat. No. 5,367,473; U.S. Pat. No. 5,371,923; U.S. patent application No. 09/273,851; U.S. patent application No. 09/401,003; U.S. patent application No. 09/453,666, application No. 09/573,981 filed by the same applicant of the present invention . . . etc. all described luggage carriers of different types. However, the drawbacks still exist and bother the users a lot.

Therefore, an objective of the present invention is to provide a retractable wheel for a built-in luggage cart to mitigate and/or obviate the aforementioned problems.

SUMMARY OF THE INVENTION

The object of the present invention is to provide a retractable wheel for a built-in luggage cart. The retractable wheel comprises a frame permanently attached to the luggage, a wheel mount and a wheel received in a wheel well in the frame, a strut movable along a vertical direction and a pair of arms having opposite ends respectively pivoted with the strut and the wheel mount of the wheel, whereby the wheel mount of the wheel is operable by a user between an extended position to enable the luggage to be movable on the wheels on the ground, and a retracted position to ease collection of the luggage, when the telescopic pull rods are extended and retracted.

Another object of the present invention is to provide a retractable wheel that can be sized to fit different sizes of built-in luggage carts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
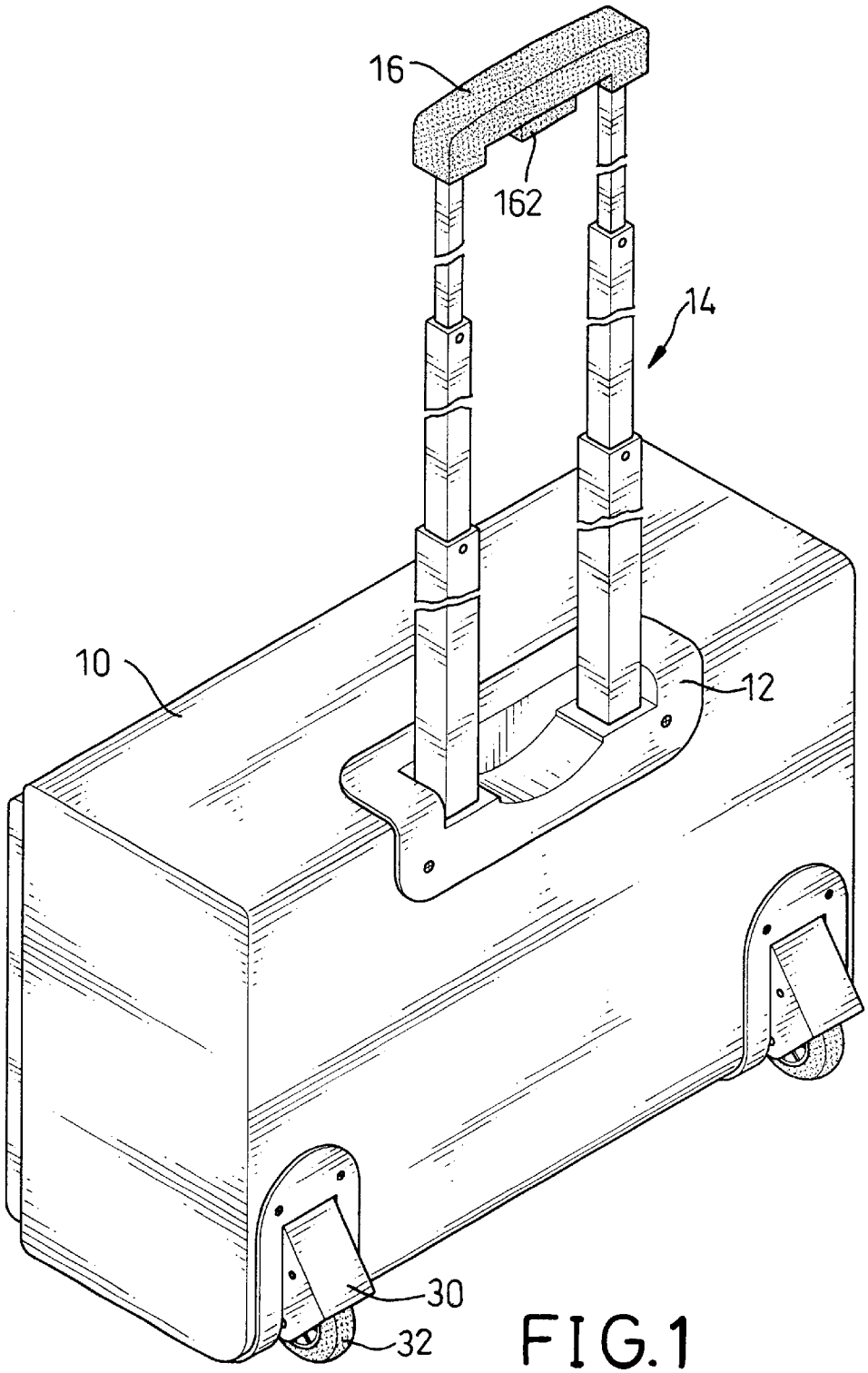
FIG. 1 is a perspective view of a built-in luggage cart with retractable wheels in accordance with the present invention.

With reference to FIG. 1, a luggage (10) with a built-in luggage cart has a piece of stiffener (12) attached to the upper edge of the back of the luggage (10), a pair of telescopic pull rods (14), a handle (16) on the upper end of the pull rods (14) and a pair of retractable wheels (32), which are mounted on opposite sides of the lower edge of the back of the luggage (10).

Figure 2:
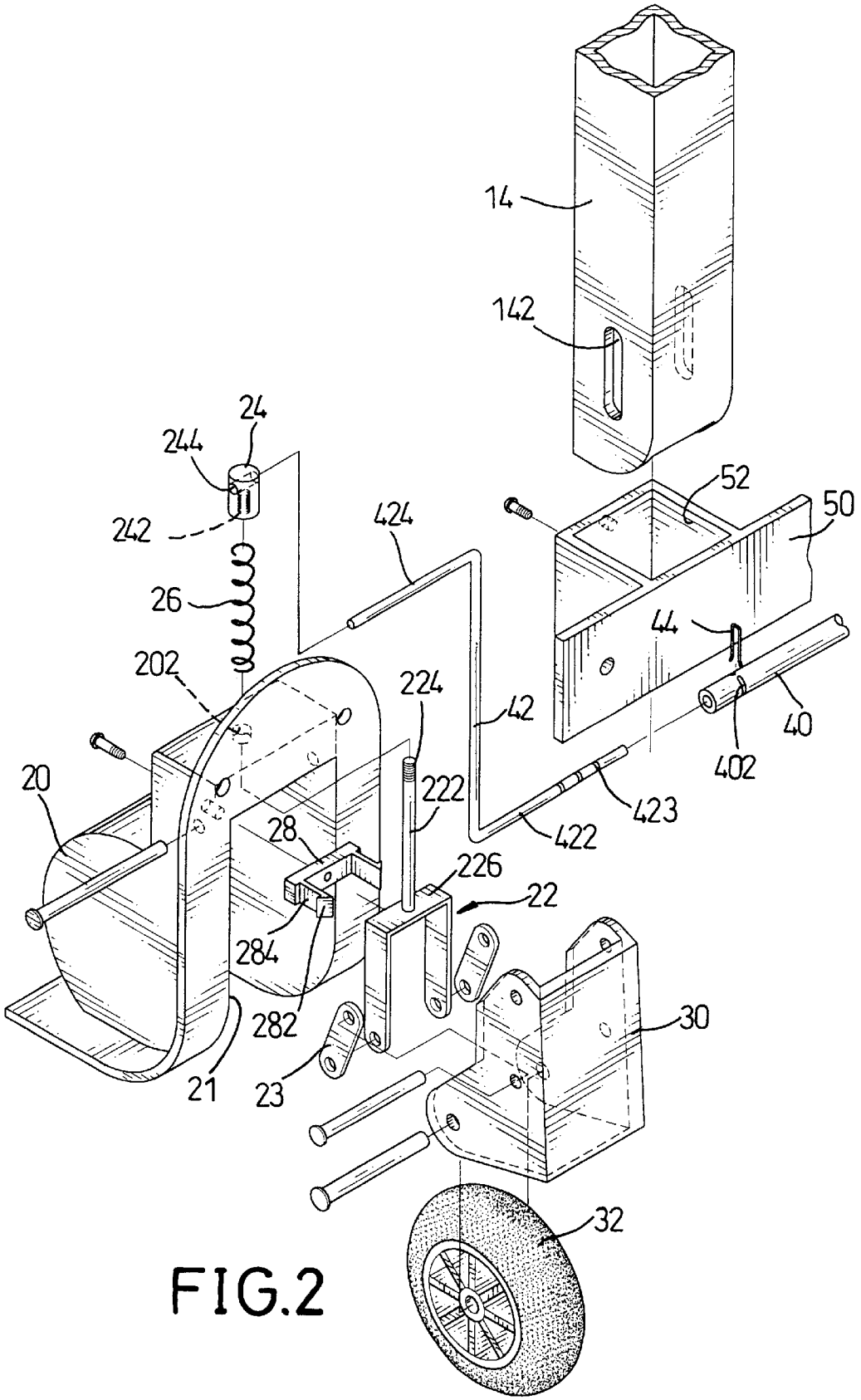
FIG. 2 is an exploded perspective view of the retractable wheel assembly in accordance with the present invention.

With reference to FIGS. 1 and 2, each retractable wheel assembly comprises a frame (20), a wheel mount (30) and a wheel (32). Each frame (20) is defined with a wheel well (21) to receive a wheel mount (30) and a wheel (32). The telescopic pull rods (14) are freed by a button (162) on the handle (16) to extend or retract the telescopic rods (14). The wheel mounts (30) with the wheels (32) are extendable and retractable when the pull rods (14) are extended and retracted.

The wheel well (21) in the frame (20) conforms to the shape and size of the wheel mount (30) and the wheel (32) to perfectly receive the retracted wheel (32) and wheel mount (30). Each wheel mount (30) has a U-shaped end cross section. The upper end of the wheel mount (30) is pivotally connected to the frame (20), and the wheel (32) is rotatably connected to the lower end of the wheel mount (30).

A strut (22) movably mounted in the frame (20) has an upright rod (222) with an inverted U-shaped member (226) formed at the lower end of the rod (222). The upper end of the rod (222) has a thread end (224) and extends through a hole (202) defined in the top wall of the frame (20). The lower ends of the two legs of the inverted U-shaped member (226) are pivotally attached to one end of a pair of arms (23), that have the other ends pivotally attached to opposite sides of the wheel mount (30). A cap (24) with a threaded hole (242) defined in the cap (24) is screwed onto the threaded end(224) of the rod (222). A spring (26) is mounted around the rod (222) between the cap (24) and the frame (20).

A guide bracket (28) attached to the frame (20) in the wheel well (21) has two guide blocks (282) extending horizontally from opposite ends of the guide bracket (28). The guide blocks (282) are respectively defined with two channels (284) on the outside faces thereof corresponding to opposite legs of the inverted U-shaped member (226). When the strut (22) is fitted in the frame (20), the legs of the inverted U-shaped member (226) are respectively held in the channels (284) of the guide bracket (28). Therefore the strut (22) is movable in the vertical direction only.

Figure 3:
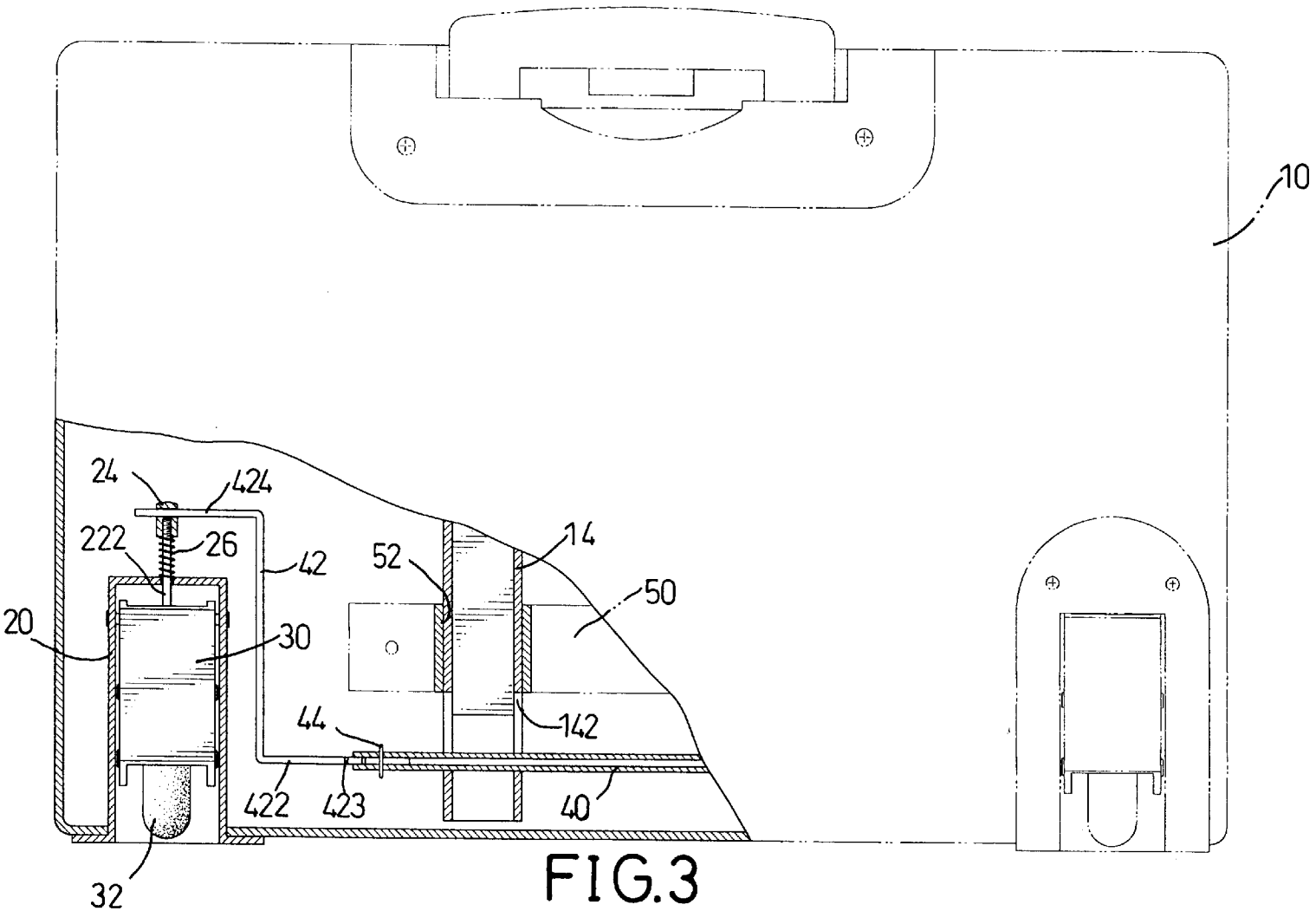
FIG. 3 is a front plan view in partial section of the retractable wheel in FIG. 2 with the wheel retracted.
Figure 4:
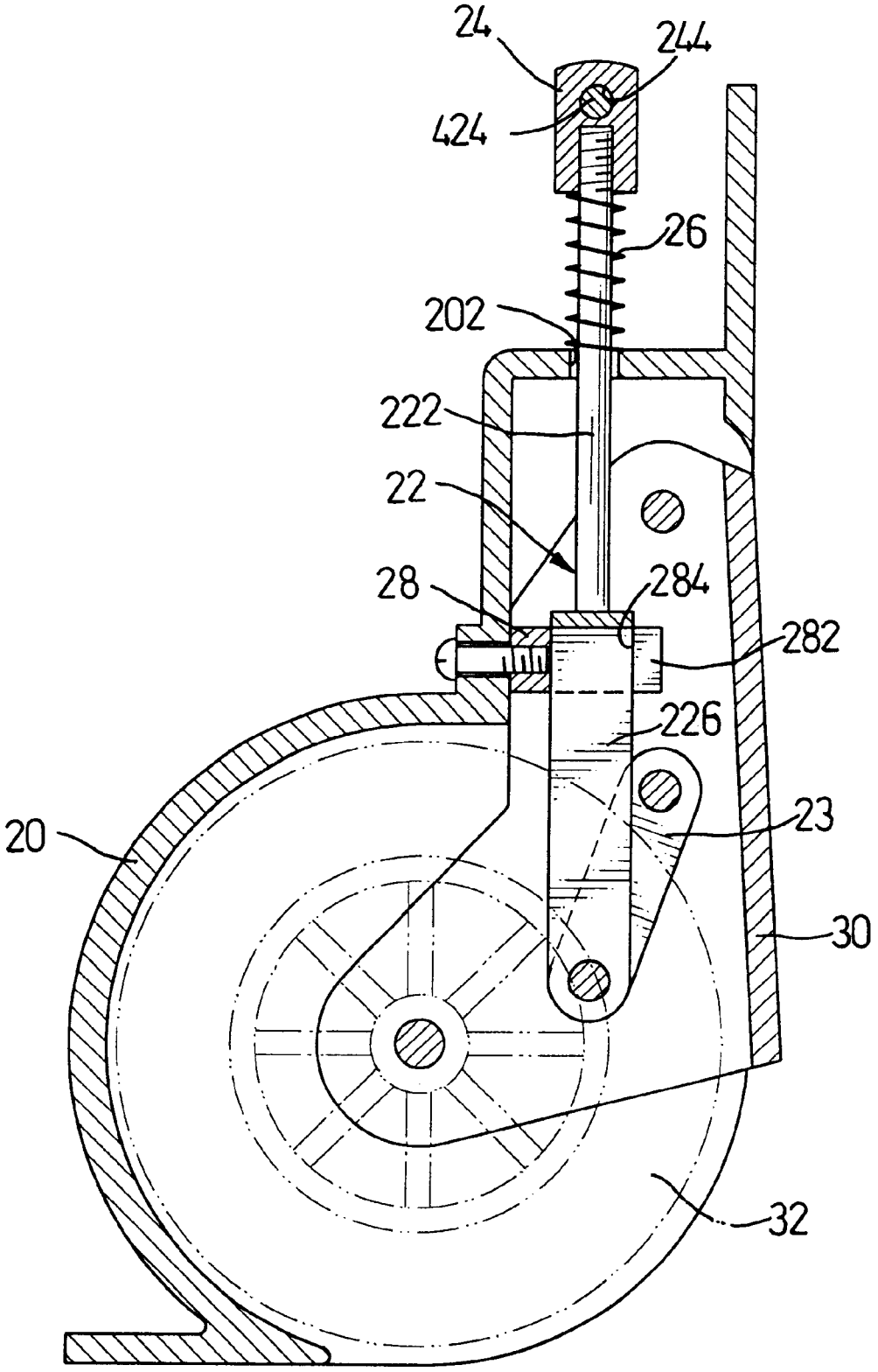
FIG. 4 is a cross sectional side plan view of the retractable wheel in FIG. 3.

With reference to FIGS. 2 and 3, the lower ends of the pull rods (14) extend through corresponding positioning holes (52) defined in a fixed plate (50), which is firmly attached to the luggage (10). Opposite ends of a cross tube (40) extend through corresponding vertical slots (142) defined in the lower ends of the pull rods (14). A connecting rod (42) is mounted between the each end of the cross tube (40) and the corresponding strut (22). Opposite wo ends (422, 424) of each connecting rod (42) are formed parallel in opposite directions perpendicular to the central shaft of the connecting rod (42). The lower end (422) is connected to one end of the cross tube (40), and the upper end (424) is connected to the cap (24) screwed onto the corresponding strut (22) by passing through a transverse hole (244) defined in the cap (24).

Multiple annular grooves (423) are defined in the lower end (422) of the connecting rod (42). A pair of parallel vertical grooves (402) corresponding the annular grooves (423) on the lower end (422) of the connecting rod (42) are defined on each end of the cross tube (40). After the lower end (422) is inserted into the corresponding end of the cross tube (40) and the appropriate annular groove (423) is aligned with the pair of grooves (402) in the connecting cross tube (40), a clip (44) is inserted into the pair of grooves (402) and the aligned annular groove (423) to hold the connecting rod (42) in place. Because there are multiple annular grooves (423) in the connecting rod (42), the length of the lower end (422) and the cross tube (40) is adjustable.

With reference to FIG. 3, when the telescopic pull rods (14) are completely retracted, the lower ends of the inner extension tubes of the pull rods (14) press the cross tube (40) to a lower position. The strut (22) connected to the connecting rod (42) is pressed to a lower position also. Because the inverted U-shaped member (226) of the strut (22) is held in vertical alignment by the channels (284) in the guide bracket (28), the strut (22) moves only vertically. The legs of the U-shaped member (226) press down on the bottom connection with the arms (23) causing them to move to a substantially vertical orientation thereby pulling the wheel mount (30) and the wheel (32) to a retracted position in the wheel well (21) of the frame (20).

Figure 5:
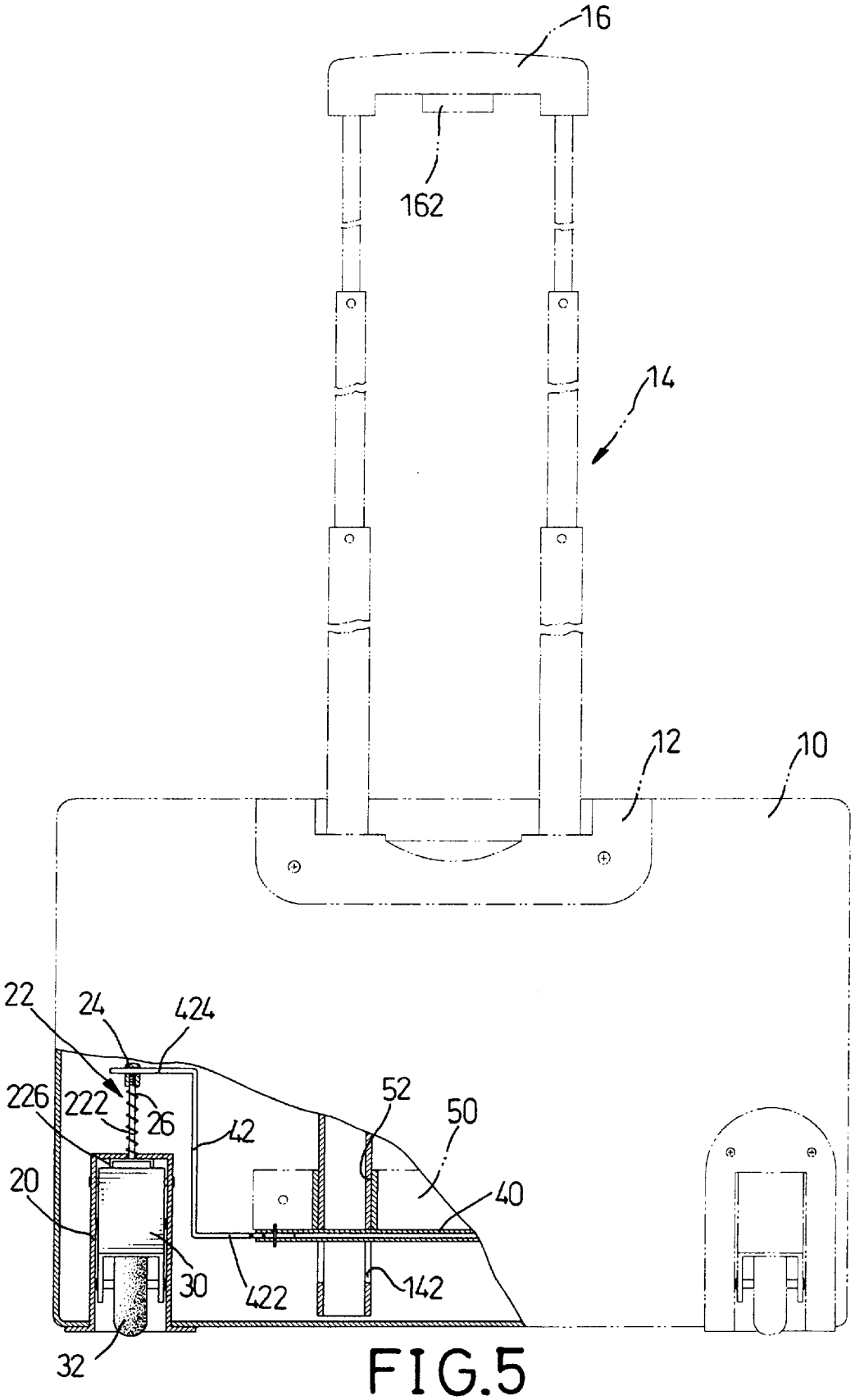
FIG. 5 is a front plan view in partial section of the retractable wheel in FIG. 2 with the wheel is extended.
Figure 6:
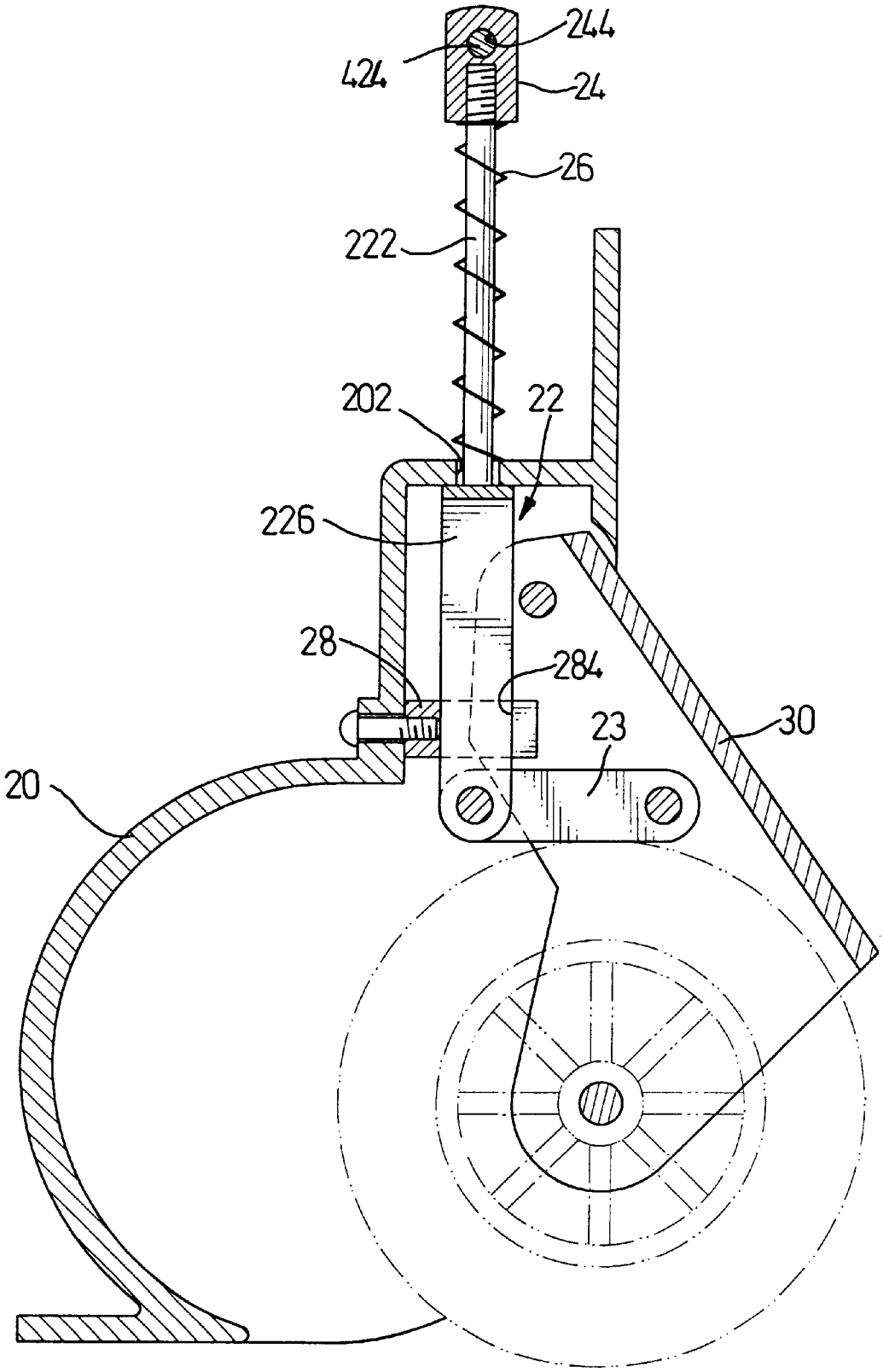
FIG. 6 is a cross sectional side plan view of the retractable wheel in FIG. 5 with the wheel extended.

With reference to FIG. 5, when the pair of telescopic pull rods (14) are extended out, the lower ends of the inner extension tubes of the pull rods (14) release the pressure holding the cross tube (40) in the lower position. The stored energy in the spring (26) presses against the cap (24) and lifts the strut (22) to an upper position. When the inverted U-shaped member (226) is pulled up, the arms (23) are forced to extend in a substantially horizontal direction causing the wheel mount (30) and the wheel (32) to extend out of the wheel well (21) in the frame (20).

From the above description, it is noted that the retractable wheels for a built-in luggage cart in accordance with the present invention have the following advantages:

1. since the structure of the retractable wheel is simple, the manufacturer is able to produce it at a lower cost;

2. the luggage (10) with the retractable wheels is easy to use and reduces the burden on travelers when carrying, storing or collecting the luggage (10); and 3. since the lower end (422) of the connecting rod (42) has multiple annular grooves (423), the length between the lower end (422) and the cross tube (40) is adjustable to accommodate different sizes of luggage.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retractable wheel for a built-in luggage cart which has a pair of telescopic pull rods (14), a handle (16) connected to upper, ends of the pull rods (14), wherein the retractable wheels are mounted at opposite sides of the lower edge of the luggage (10) near the lower ends of the pull rods (14), wherein each retractable wheel comprises:

a frame (20) that is adapted for attaching to a lower edge of the luggage (10) and having a wheel well (21) defined therein and shaped according to a wheel mount (30) and a wheel (32) which are retractable into and extendable from the wheel well (21);

the wheel mount (30) having an upper end thereof pivotally connected to the frame (20), and the wheel (32) rotatably connected to the lower end of the wheel mount (30);

a strut (22) having an upright rod (222) extending through an hole (202) defined in the top wall of the frame (20), and an inverted U-shaped member (226) formed at the lower end of the rod (222);

a pair of arms (23) with one end of each arm (23) pivotally connected to a lower end of one of the legs of the inverted U-shaped member (226) of the strut (22), and the other end of each arm (23) pivotally connected to one side of opposite sides of the wheel mount (30);

a cross tube (40) having, opposite end, respectively extending through the lower ends of the corresponding pull rods (14);

a connecting rod (42) having opposite ends respectively connected to the upper end of the rod (222) of the strut (22) and the cross tube (40); whereby when the telescopic pull rod (14) is extended, the strut (22) is lifted to an upper position, the arms (23) are forced to extend in a substantially horizontal direction to move the wheel mount (30) pivotally out of the wheel well (21) of the frame (20); when the telescopic pull rod (14) is retracted, the strut (22) is pressed to a lower position, the arms (23) are forced to extend in a substantially vertical direction to pull the wheel mount (30) pivotally retracted into the wheel well (21) of the frame (20).

2. The retractable wheel for the built-in luggage cart as claimed in claim 1, wherein the wheel mount (30) has a U-shaped end cross section.

3. The retractable wheel of the built-in luggage cart as claimed in claim 1, wherein each pull rod (14) has two corresponding vertically slots (142) defined on opposite sides near the lower end, so the cross tube (40) can extend through the slots (142).

4. The retractable wheel of the built-in luggage cart as claimed in claim 1, wherein a fixed plate (50) is firmly attached to the luggage (10), two positioning holes (52) are defined in the fixed plate (50) to hold the lower ends of the pull rods (14).

5.The retractable wheel of the built-in luggage cart as claimed in claim 1, wherein a threaded end (224) is formed on the upper end of the rod (222) of the strut (22), a cap (24) having a threaded hole (242) is screwed onto the threaded end (224) of the rod (222).

6. The retractable wheel of the built-in luggage cart as claimed in claim 5, wherein a spring (26) is mounted around the rod (222) between the cap (24) and the frame (20).

7. The retractable wheel of the built-in luggage cart as claimed in claim 1, wherein a guide bracket (28) attached to the frame (20) in the wheel well (21) has two guide blocks (282) extending horizontally from opposite sides of the guide bracket (28), a channel (284) is defined on the outside face of each guide block (282) and corresponds to one of the two legs of the inverted U-shaped member (226) of the strut (22).

8. The retractable wheel of the built-in luggage cart as claimed in claim 5, wherein the connecting rods (42) has a lower end (422) connected to the cross tube (40), and an upper end (424) connected to the cap (24).

9. The retractable wheel of the built-in luggage cart as claimed in claim 8, wherein multiple annular grooves (423) are defined around the lower end (422) of the connecting rod (42), a pair of parallel vertical grooves (402) corresponding to the plurality of recesses (423) are defined on opposite ends of the cross tube (40), whereby after the lower end (422) is inserted into the end of the cross tube (40), the lower end (422) of the connecting rod (42) is connected to the cross tube (40) by a clip (44) inserted into the grooves (402) in the cross tube (40) and into an aligned annular groove (423) around the lower end (422).

10. The retractable wheel of the built-in luggage cart (10) as claimed in claim 8, wherein the upper portion (424) is inserted through a transverse hole (244) defined in the cap (24).

* * * * *